United States Patent [19]

Compa et al.

[11] 4,041,205

[45] Aug. 9, 1977

[54] RESIDUE-FREE FABRIC SOFTENING ARTICLE FOR USE IN LAUNDRY DRYER

[75] Inventors: Russell Edward Compa, West Orange; Marvin Liebowitz, Edison; Ralph Paul Messina, Somerset, all of N.J.

[73] Assignee: Colgate-Palmolive Company, New York, N.Y.

[21] Appl. No.: 407,477

[22] Filed: Oct. 18, 1973

[51] Int. Cl.[2] ..... D06M 13/00

[52] U.S. Cl. ..... 428/220; 252/8.6; 252/8.7; 252/8.75; 252/8.8; 252/8.9; 427/242

[58] Field of Search ..... 252/8.6, 8.9, 8.8, 259.5, 252/130, 155, 174, 91; 117/120, 139.5 CQ, 139.5 C; 427/242

[56] References Cited

U.S. PATENT DOCUMENTS

| | | | |
|---|---|---|---|
| 3,442,692 | 5/1969 | Gaiser | 117/120 |
| 3,549,545 | 12/1970 | Stolmeijer | 252/259.5 X |
| 3,676,199 | 7/1972 | Hewitt et al. | 117/139.5 X |
| 3,676,357 | 7/1972 | Ciuti et al. | 252/259.5 |
| 3,686,025 | 8/1972 | Morton | 252/8.9 X |
| 3,696,034 | 10/1972 | Hewitt et al. | 252/8.8 |
| 3,826,682 | 7/1974 | Liebowitz et al. | 252/8.6 X |
| 3,862,058 | 1/1975 | Nirschl et al. | 252/8.8 X |

*Primary Examiner*—Herbert B. Guynn

*Attorney, Agent, or Firm*—Herbert S. Sylvester; Murray M. Grill; Norman Blumenkopf

[57] ABSTRACT

An improved article for conditioning fabrics includes at least one fabric conditioning compound, such as a softening agent, and a reinforcing, strengthening or extending material. The fabric conditioning compound and the article comprising it are usually of a waxy nature and are abradable or otherwise transferable to damp, warm fabrics by repeated contacts therewith experienced during tumbling effected in a drying zone, as of an automatic laundry dryer, through which hot drying air normally circulates. When such a softening article is rubbed against fabrics with which it comes in contact in the heat of the drying zone, softener is rubbed off onto the fabrics to be conditioned, after which the fabrics and laundry containing them are dried. The reinforcing or strengthening material is also dried at that time and is either removed from the fabrics by exiting drying air or is desirably held onto the fabrics that were treated, in conjunction with the softening agent. Preferred reinforcing materials are small fibers or particles or natural or synthetic gums or binders. In an aspect of the invention the fabric conditioning compound is employed without reinforcing means and in convenient sheet, strip or other such substrate-free form, preferably with an added humectant or plasticizer. Also described are methods for the use of the softening articles and processes for their manufacture.

11 Claims, No Drawings

RESIDUE-FREE FABRIC SOFTENING ARTICLE FOR USE IN LAUNDRY DRYER

This invention relates to the conditioning of fabrics. More particularly, it relates to softening fabrics, such as those in laundry items, by means of a reinforced conditioning article which includes a fabric conditioning compound and reinforcing or strengthening means. The reinforcing means prevents the fabric conditioning article from prematurely disintegrating during the conditioning operation, which is preferably carried out in the drying zone of an automatic laundry dryer, and is either removed from such zone with the drying air or is usefully deposited on the fabrics together with the conditioning compound or composition. In some cases, substrate-free sheets or strips of the conditioner are used without reinforcements, when the conditioner does not stain the laundry and is sufficiently strong so that it does not prematurely disintegrate in the dryer.

The conditioning of fabrics is an accepted procedure normally undertaken by the consumer, generally in conjunction with the laundering of clothing and other articles made from the fabrics. The most common conditioning effected is softening and in the past it has usually been performed by adding a substantive softening agent to the rinse water after washing of the items to be treated. After drying, some of the softening agent is present on the laundered items and contributes its softening and sometimes, anti-static effects, to the fabrics. Substantive softening agents have also been formulated into detergent compositions and a proportion of the softener content is substantive to the washed fabrics, despite the presence of detergent and despite subsequent rinsing. However, such methods are either inconvenient or are wasteful of conditioning agent, or both. The better method, utilizing the softening agent in the rinse, still requires the presence of the operator of the washing machine when the final rinse is started or else a special washing machine or addition means must be utilized. Because of the problems encountered with the prior art softening and conditioning methods, efforts have been made to apply conditioning agents to laundry in the drying operations, as by addition of such materials to a drying zone, as in an automatic laundry dryer, where they contact the tumbling laundry and adhere to it. No extra trip to the laundry is required of the operator using such a technique.

Various methods have recently been described for applying conditioning agents, such as softeners, to laundry in the dryer. One such method, utilizing a paper strip impregnated with softening agent, is illustrated by U.S. Pat. No. 3,442,692 of Gaiser. Other methods, compositions, articles and apparatuses are disclosed in U.S. Pat. Nos. 3,632,396 (Perez Zamora); 3,634,947 (Furgal); 3,650,816 (Rudy et al.); 3,676,199 (Hewitt et al.); 3,686,025 (Morton); 3,696,034 (Hewitt et al.); 3,698,095 (Grand et al.); and 3,743,534 (Perez Zamora).

The disclosures of the above-mentioned patents are hereby incorporated by reference, especially for the descriptions therein of conditioning materials employed, more specifically for the descriptions of softening agents and softening compositions.

In the mentioned patents there are described paper, cloth and other substrates of woven and non-woven types utilized as supports for conditioning materials. Although paper sheets impregnated or coated with conditioning agents have been found to be capable of conditioning laundry contacted by them in the drying zone of an automatic laundry dryer, certain disadvantages are inherent in their use. First, the surface deposits of conditioning agents on the paper (or cloth) may crack and separate from the substrates, usually due to unequal flexing limits of the conditioners and the substrates. This can lead to depositing of too much conditioning agent in a particular locality, which can cause staining of the treated fabric. When the conditioning or softening agent is impregnated in the paper or cloth that in the interior thereof may be unused at the end of the treatment, resulting in waste and greater expense of the product for the same softening activity. The use of particular softening compositions, sometimes modified by the presence of a plasticizer or humectant, and the employment of rigid, rather than flexible substrates, helps to prevent staining due to the softening agent cracking off from the substrate but it still remains to remove the substrate item itself from the treating zone after completion of the softening operation. This may sometimes be an annoying task, due to the substrate being "lost" in the laundry. Also, with light substrates, such as papers from which enough softener has been removed to make them light and easily airborne, they may be carried by the drying air to locations out of contact with the tumbling laundry. In such cases, they can impede air flow and interfere with desired dryer operation. In some instances, as when only one side of the substrate is coated, less efficient transfer of the conditioning agent to the laundry results.

Using the fabric conditioning articles of the present invention and practicing the conditioning methods thereof, however, allows the convenient and efficient softening of laundry in the automatic laundry dryer without requiring locating the substrate for the conditioning article after completion of the conditioning operation. Thus, all that is necessary is to add the article to the dryer drum full of damp laundry to be dried. Then it may be forgotten. The clothes will automatically be softened and there is no need to examine all the laundry items to pick out the piece of paper or other substrate nor is there any need to examine the dryer drum and other parts of the dryer to find and remove the paper or cloth substrate or pieces or shreds of the paper.

In accordance with the present invention there is provided for use in the conditioning of laundry a solid fabric conditioning article which comprises at least one fabric conditioning compound and a reinforcing material for such compound to prevent premature disintegration of the article during use in the conditioning of moving fabrics in the drying zone of an automatic laundry dryer by contact of the article with them to transfer conditioning agent to them, which reinforcing material gradually disintegrates during use of the conditioning article and leaves no residue in the drying zone after use thereof. In a preferred embodiment of the invention the fabric softening article includes as a fabric softening compound a higher fatty alkyl di-lower alkyl glycine or a higher fatty acyl amidopropyl di-lower alkyl glycine. Such amphoteric materials are compatible with various other ionic and nonionic conditioners and are good softeners. Di-higher alkyl di-lower alkyl ammonium halides and other quaternaries such as higher fatty alkyl di-lower alkyl benzyl ammonium halides or poly-lower alkoxylated derivatives thereof are also good but are less compatible and can stain laundry if improperly used. The reinforcing material may be of finely divided cellulose fibers or particles or polyvinyl alcohol or a mixture thereof, with the fibers of cellulose being small enough so that they form, with the other softening composition constituents, a substrate which is desirably disintegrable under the conditions of use in the dryer as the softening composition is abraded onto the fabrics, but does not prematurely disintegrate. Also within the invention are substrate-free sheets or strips of conditioning agent or composition. The invention is also of methods of making and using the described solid fabric conditioning articles.

The fabric conditioning compounds which may be employed in making the present articles are preferably amphoteric or Zwitterionic softeners for better softening effects, compatibilities, and less dangers of staining treated laundry or fabrics. Preferred among these are the derivatives of di-lower alkyl glycine, which may be in betaine form. Such glycine derivatives are of the formula

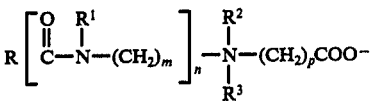

wherein R is a higher fatty alkyl or mono-unsaturated alkenyl, $R^1$ is hydrogen or lower alkyl and $R^2$ and $R^3$ are lower alkyls. The subscripts *m*, *n* and *p* are numbers from 1 to 5, 0 or 1, and 1 to 3, respectively. The higher alkyls R, or acyls

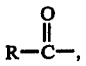

are of 10 to 20 carbon atoms, e.g., lauroyl, myristyl, palmitoyl, palmityl, stearoyl, stearyl, oleyoyl. $R^1$ is usually hydrogen but may also be lower alkyl, preferably of 1 to 3 carbon atoms, such as methyl, ethyl, n-propyl and isopropyl, while $R^2$ and $R^3$, which may be same or different, are lower alkyls, also preferably of 1 to 3 carbon atoms, such as those described for $R^1$. The most preferred alkyl for $R^2$ and $R^3$ is methyl. Although *m* may be such as to produce an alkylene, e.g., methylene, ethylene, propylene, butylene or amylene, it has been found that the propylene embodiment, wherein *m* is 3, is preferred when *n* is 1. Whether *n* is 0 or 1, it is also preferable that *p* be 1, although ethylene and propylene radicals also may usefully connect the nitrogen and the acyl carbon of the dimethyl glycine moiety.

The most preferred dialkyl glycine derivatives used are cocoyl dimethyl glycine and cocoyl amidopropyl dimethyl glycine. The preferred fatty acid groups, which are mainly of 10 to 14 carbon atoms, but may be of 10 to 20 carbons, as the name indicates, are obtained from coconut oil fatty acids, as are the alkyls of the same carbon atom contents. Other synthetic and naturally occurring higher fatty acids that may be used occur in tallow, corn oil, palm kernel oil, palm oil, greases and various other vegetable oils and animal fats. These may be converted to the corresponding fatty acids or alcohols or sometimes, may be used as the tridglycerides. They may be fractionated or purified to particular products, such as topped coconut oil acids, commercial stearic acid, double or triple pressed stearic acid, which then may be reacted to produce the desired dialkyl glycine derivatives. In addition to the preferred compounds, other materials which are also useful in the practice of this invention, either alone or preferably, with the mentioned preferred softening and anti-static agents, are coconut oil fatty acids amidomethyl dimethyl glycine; tallowyl amidopropyl dimethyl betaamino acid; stearoyl N-methyl amido-n-butyl di-n-propyl glycine, stearyl dimethyl glycine, cocoyl diethyl gammaamino acid and tallowyl dimethyl betaamino acid.

Other amphoteric conditioners that have been found to be most useful at the present time are the complex fatty amido compounds such as the Soromines®, e.g., Soromine AT and Soromine AL, sold by GAF Corp. Various other amphoteric compounds, usually possessing primarily cationic properties under final use conditions, include the higher alkyl beta-alamines, the N-higher alkyl taurines, e.g., the reaction product of lauryl amine with sodium isethionate, the N-higher alkyl aspartic acids and the Miranols®, described in U.S. Pat. No. 2,528,378. Related compounds which are useful include the Zwitterionic surface active agents such as the betaines and similar detergents which form inner salts. Others are described in the patents incorporated by reference.

The anionic surface active materials which are useful as fabric conditioners (that term means that the conditioning agent softens and/or diminishes static charge accumulation on the fabric) include water soluble salts such as the soluble salts of organic sulfuric reaction products which have an alkyl radical of from about 8 or 10 to about 18 or 20 carbon atoms and either a sulfonic acid or sulfuric acid ester radical. The corresponding compounds containing acyl groups of similar chain length are also included. Representative of these materials are the higher alkyl sulfates of from 18 to 20 carbon atoms, the higher alkane sulfonates, e.g., paraffin sulfonates, the higher olefin sulfonates, e.g., higher alpha-olefin sulfonates of 8 to 20 carbon atom olefins, the higher alkyl benzene sulfonates, preferably the linear alkyl benzene sulfonates wherein the alkyl group is of 10 to 18 carbon atoms, preferably from 12 to 15 carbon atoms, the higher fatty acyl taurides and isethionates, higher fatty acid monoglyceride sulfates and sulfonates, higher fatty glycerol ether sulfonates, the sulfuric acid esters of reaction products of 1 mol of higher fatty alcohol with from 1 to 6 mols of lower alkylene oxide and alkyl phenyl lower alkylene oxide ether sulfates containing from 1 to 10 mols of lower alkylene oxide per molecule. Specific examples of such materials include sodium tallow alcohol sulfate, sodium hydrogenated tallow alcohol sulfate, sodium lauryl sulfate, sodium paraffin sulfonate, potassium and sodium alpha-olefin sulfonates of 18 carbon atoms in the olefin, triethanolamine n-hexadecyl sulfate, trimethylamine cetyl sulfate, potassium n-octadecyl sulfonate, sodium coconut oil fatty acid monoglyceride sulfate, sodium n-dodecyl benzene sulfonate, sodium tetradecyl toluyl sulfonate, nonyl phenyl polyoxyethylene sulfate wherein the polyoxyethylene group is of 5 mols of ethylene oxide, sodium dodecyl glycerol ether sulfonate and potassium oleyl N-methyl tauride. Such compounds may be employed alone or in mixture.

In addition to the synthetic anionic organic detergents, the water soluble higher fatty acid soaps may also be employed. These are usually the alkali metal salts of higher fatty acids of 8 to 20 carbon atoms, preferably 12 to 18 carbon atoms and are normally derived from natural sources, such as coconut oil, palm oil, corn oil, tallow and mixtures thereof. However, trialkanolamine and trialkylamine salts such as triethanolamine soaps may be used, as may be other known soluble soaps suitable for the present purposes. Exemplary of such materials are the sodium soaps of an 87:13 mixture of tallow and coconut oil fatty acids, the potassium soap of stearic acid, the mixed sodium and potassium soaps of a 50:50 mixture of tallow and coconut oil fatty acids, sodium "cocate", potassium stearate, triethanolamine stearate and sodium laurate.

In addition to the water soluble salts, the water insoluble salts of calcium, magnesium, lithium, and other "heavy" metals which form water insoluble soaps may be employed. However, it may be generally be preferred to utilize the corresponding water soluble products which are less difficult to incorporate and use in the present products. Among the most useful of the soaps mentioned are the sodium soaps of tallow fatty acids and sodium soaps of mixed tallow and coconut oil fatty acids. Corresponding triethanolamine soaps, such as triethanolamine stearate, may be used in part but are not as resistant to premature disintegration, especially in the unreinforced conditioner products described.

Of the nonionic surface active materials which are useful as fabric conditioners, some preferred embodiments include the polyoxy-lower alkylene higher alkyl ethers, e.g., polyoxyethylene lauryl ether having four ethoxy groups (Brij 30); higher alkylphenoxy poly(-lower alkoxy) lower alkanols, e.g., nonyl phenoxy polyethoxy ethanol (Igepal CO-880); and balanced hydrophilic-lipophilic compounds made by the condensation of lower alkylene oxides with an organic hydrophobic material, e.g., Pluronics. The nonionic softeners usually include lipophilic groups having higher alkyl components, generally of 8 to 20 carbon atoms and hydrophilic components which are poly-lower alkylene oxides, often having 4 to 20 mols of lower alkylene oxide per mol. The lower alkylene oxides are of 2 to 3 carbon atoms, preferably being ethylene oxide.

Other useful nonionic softeners include the amine oxides and the alkanolamides. The former are usually higher alkyl di-lower alkyl amine oxides wherein the higher alkyl is of 8 to 20 carbon atoms and the lower alkyl is of 1 to 4 carbon atoms, preferably being methyl. The alkanolamides may be mono and di- lower alkanolamides of higher fatty acids, e.g., myristic diethanolamide, palmitic monoethanolamide.

The cationic conditioners include the quaternary ammonium halides which will usually contain a plurality of lower alkyl groups on the quaternary nitrogen atom and one or two higher alkyls, benzyls or equivalent groups thereon. The salt-forming ion will preferably be a chloride or bromide and of these the chloride is normally preferred, but it may also be another useful solubilizing radical or group. Preferred quaternary ammonium compounds that may be employed are distearyl dimethyl ammonium chloride, stearyl dimethyl benzyl ammonium chloride and bromide and polyethoxylated higher alkyl analogues, but other quaternaries of similar activity may also be used, including cetyl trimethyl ammonium bromide, dimethyl dilauryl ammonium chloride, diethyl distearyl ammonium chloride, dimethyl di-(hydrogenated tallow alkyl) ammonium chloride, stearyl dimethyl benzyl ammonium chloride and lauryl methyl dibenzyl ammonium bromide. Among the cationics that may be employed are alkyl pyridine salts, alkyl imidazolines, higher alkylamines of the primary, secondary or tertiary types, and higher alkyl guanidine salts, e.g., 1-methyl-1-stearyl aminoethyl-2-stearyl imidazolinium methosulfate, stearyl pyridinium chloride and bromide, cetyl isoquinolinium bromide and higher alkyl morpholinium chlorides. In the aforementioned cases lower alkyls are from 1 to 5 carbon atoms, preferably 1 or 2, and higher alkyls are of 8 to 20 carbon atoms, preferably 12 to 18. Although mixtures of the cationic softeners and anti-static agents with nonionic, amphoteric or Zwitterionic softeners may be employed, such mixtures with anionics should be used with care and often will be avoided, due to objectionable chemical interactions.

Various other softening and anti-electrostatic charge conditioning agents are found listed in McCutcheon's *Detergents and Emulsifiers,* 1973 Annual, North American Edition, where the various surface active agents are classified an anionic, cationic, nonionic and amphoteric and those having especially good conditioning properties are listed. In the description herein and in the cited listings, unless otherwise indicated, the higher alkyls will usually be of 8 to 20 carbon atoms and the lower alkyls will be of 1 to 4 carbon atoms, with the preferred compounds often having higher alkyls of 12 to 18 carbon atoms and lower alkyls of 1 or 2 carbon atoms.

The softening compounds employed are preferably in solid form so that solid, form-retaining (although somewhat flexible) conditioning articles may be made from them. However, semi-solid and even liquid materials may be employed in mixture with other softening compounds of greater solidity or in the presence of carriers or adjuvants which make the final composition normally solid at room temperature (18°-25° C.) and even higher, e.g., 43° C.

The reinforcing materials for the fabric conditioning compounds are those which will add sufficient strength, when combined with the softening and other components of the softening composition present, so as to make the softening article produced able to withstand the tumbling action of the dryer and the contacts made with damp laundary without prematurely disintegrating. Thus, instead of breaking apart when first contacted by the laundry, when it is comparatively cold, the normally waxy conditioning agent, with the reinforcing fibrous, particulate or gum component mixed with it, tends to hold together better. The softening agent coats the fibers or particles and will assist in maintaining them in their original configurations and serves as a medium in which the gum, hydrophilic colloid or binder will be held. Yet, as the fabric softening agent is transferred to the tumbling laundry by repeated contact with it in the drying zone the reinforcing material left, no longer held in position by the softening compound and no longer covered by it and thereby protected against contact with moisture in the drying zone, gradually disintegrates if it is normally insoluble in water and does not dissolve or melt under dryer conditions. If the reinforcing material is water soluble or fuses under drying conditions, it may be applied to the tumbling laundry with the softening composition and may have an additional useful effect on the laundry being treated. The softener article may hold together in a strip or sheet during use or may break up into smaller strips or pieces when subjected to tumbling actions with laundry to be dried. Such strips or pieces may be better able to distribute the conditioner than a single sheet and such break-up may be advantageous, depending, of course, on piece sizes. The sizes of the pieces of sheeting, even after breaking, will usually be of a surface area over 10 sq. cm. The break-up mentioned is not premature disintegration, which results when the article becomes powdered or so finely divided that the conditioner and reinforcement separate within about 1 minute or less in the drying zone and the lighter parts thereof become airborne and are removed from the softening and drying zone with the dryer exhaust air.

It is desirable to maintain the reinforcement with the softener since it helps to produce more even softening when laundry is contacted with the reinforced particles.

Among the most preferred of the reinforcing materials are finely divided wood cellulose, cotton or other cellulosic or other textile fibers or particles. These normally will have a suitable length and diameter and will be of structure as to make them tend to hold together, so as to reinforce the softener, while not having sufficient strength to maintain such hold under dryer conditions after the softener is removed. In other words, after conditioner removal no sheet or strip remains. Normally, with respect to fibrous or similar materials, e.g., celluloses, lengths from 0.005 to 1 millimeter, preferably from 0.025 to 0.1 mm., and diameters of 0.001 to 0.1 mm., preferably from 0.002 to 0.01 mm., are employed. Length:width ratios are usually about 3:1 to about 500:1, preferably from 5:1 to 20:1. Suitable such materials are the purified celluloses such as microcrystalline and finely divided celluloses, representative of which are those sold as Varicel, Solka-Floc and Solka-Floc BW, made by Ashland Chemical Co. and Brown Corp., respectively. Similarly microcrystalline protein and nylon are usable. With particulate materials, their structures or electrical charges will generally be such as to aid in binding them together in the matrix of softening composition. Thus, diatomaceous earths, clays, e.g., bentonite, other materials, powdered synthetic water insoluble organic polymers (plastics), animal and vegetable particles may be used, with normal particle sizes being from 0.001 to 1 mm., preferably from 0.005 to 0.5 mm. In some instances, it may be desirable to utilize mixtures of the particulate and fibrous reinforcing agents, e.g., silica and Solka-Floc BW.

Instead of the fibrous or particulate materials natural or synthetic gums or gum-like compounds may be utilized and these are preferably water soluble. In place of the gums other resinous materials having cementing properties may be employed, including synthetic organic polymers in discontinuous form (so that they do not form a unified substrate after removal of the softening agent). Alternatively, fatty materials (in non-staining proportions) and hydrophilic polymers can be employed. These include paraffins, higher fatty acids, e.g., stearic acid, tallow fatty acids, hydrogenated tallow fatty acids, triglycerides, diglycerides and monoglycerides and poly-lower akylene glycols, e.g., polyethylene glycols of a molecular weight of 5,000 to 100,000, preferably 10,000 to 30,000.

Among the gums most preferred are the water soluble synthetic synthetic organic polymers such as polyvinyl alcohol, hydrolyzed polyvinyl acetate, sodium carboxymethyl cellulose, hydroxypropyl methyl cellulose, methyl cellulose, ethyl cellulose, hydroxy-lower alkylated starches, starch esters, other modified starches, polyacrylamide, and polyvinyl pyrrolidone. The fibers or particulate insoluble polymers that may be employed include phenol formaldehydes, nylons, polyesters, e.g., terephthalates, ABS resins, polyvinyl chlorides, polystyrenes, and many other such polymers. In some cases, the particles of insoluble material may act as nuclei about which "skins" of softening agent form, thereby strengthening the softening article. When the gums or hydrophilic colloids are water soluble or when water soluble natural gums, such as alginates, agars, carob bean gums, Irish moss, gelatins and starches are utilized, the strengthening appears to be by a different mechanism and the results are also somewhat different but in both cases good transfer of softening agent from the article to the laundry are obtainable.

When employing insoluble particles or fibers, as the softening agent is removed therefrom the particles or fibers break apart and, being light, are carried out the dryer exhaust, possibly being entrapped by a lint trap. They leave no residues on the clothes and in cases where such residues are to be avoided this procedure is most preferable. However, when it is desired to add body, soil repellency or laundry anti-redeposition properties to the fabric treated it may be well to utilize the natural or synthetic gums or hydrophilic colloidal materials, e.g., polyvinyl alcohol. At least some of the polyvinyl alcohol will dry during the drying zone treatment of the laundry with the softener article and will become powdered and carried out through the exhaust but some of it, together with the softening agent, will deposit on the laundry in a fairly uniform coating so as to give the laundry desired properties.

Although the preferred embodiments of the present invention involve the use of amphoteric softening agents and cationic softeners are very effective, in those instances where possible staining is a very severe problem (with cationics), as with delicate fabrics which show "greasy" stains, it may be preferred to employ an anionic softener, such as a sodium soap of a higher fatty acid of 12 to 18 carbon atoms or a mixture of such acids. In such products, although polyvinyl alcohol is useful, it is preferred to employ the finely divided cellulose fibers, e.g., purified wood cellulose, of the sizes previously mentioned, most preferably with the PVA.

Another way to eliminate possible staining due to cationic materials such as the quaternary ammonium halides is to mix these with other fabric softeners, preferably nonionics or amphoterics, so that when abraded onto the laundry there will not be overconcentrations in any particular spot. Very useful softeners for extending the quaternary ammonium cationics include the higher fatty acid mono-lower alkanolamides, e.g., stearic monoethanolamide, sold as Monads (manufactured by Mona Industries) and nonyl phenoxypolyethoxy ethanol (Triton N-101, manufactured by Roman & Haas, Inc.). In such mixtures the proportion of the quaternary ammonium halide will normally be from 0.5 to 50% of the total softener content, preferably from 1 to 10% thereof. The presence of PVA or cellulose fibers in the softening article also helps to decrease or eliminate staining.

To assist in maintaining the flexibility of the product it may often be useful to include in the formulation a material which has humectant, solvent (non-volatile) or plasticizer properties. The best of such compounds is glycerol but propylene glycol, other lower alkylene glycols, sorbitol, other sugar alcohols, diethylene glycol and other lower ether alcohols may be employed, usually of carbon contents of less than 10 carbon atoms, preferably less than 6 carbon atoms and containing from 2 to 6 hydroxyl groups per mol.

For compositions based on an amphoteric higher fatty alkyl di-lower alkyl glycine or higher fatty acyl amidopropyl di-lower alkyl glycine, or a mixture of such amphoterics, it may be desirable to have present an anionic detergent material, such as a soap. Preferably this soap will be a soap of a higher fatty acid, e.g., sodium stearate or sodium cocate-stearate. Together with the soap there will often be present a humectant of a type previously mentioned, e.g., glycerol, propylene glycol, and sometimes an additional nonionic detergent material, e.g., stearyl dimethyl amine oxide, Brij 30, Igepal CO-880 or Tween 61. However, the soaps and other anionic materials will normally be avoided when utilizing the quaternary ammonium halides and other completely cationic softeners.

In addition to the major constituents of the present compositions, described above, which are used to produce the desired reinforced softening compound, various adjuvants may be employed to impart additional useful properties to the product. Thus, perfumes, bactericides, fungicides, fluorescent brightening agents, e.g., of the aminostilbene type, antiredeposition agents, enzymes, encapsulated adjuvants, fabric finishes, may be present, usually in minor proportion, e.g., up to 1% and generally totaling no more than 5% of the final compositions. The fluorescent brighteners have a noticeable effect on the treated laundry, even when employed in very small concentrations, e.g., less than 0.05%.

The proportions of the various constituents in the softening articles of this invention are regulated to obtain the desired stability of the article, with satisfactory abradability thereof and gradual removability of the reinforcing material during use, preferably over about 50 to 95% of the drying cycle, e.g., over 1 to 57 minutes. Normally the proportion of softener will be from 5 to 99%, with the proportion of finely divided particles or gums being from 1 to 95%. Preferably, the proportion of softener or mixture of softeners will be from 10 to 99% and that of cellulosic fibers or other reinforcing agent will be from 1 to 40%. The proportion of humectant, if present, will generally be from 0.5 to 30% and is preferably about 5 to 25%. When soap is present with the higher fatty alkyl di-lower alkyl glycine or higher fatty acyl amidopropyl di-lower alkyl glycine or other amphoteric the proportion thereof is generally from 1 to 20%, preferably 5 to 15%. Moisture may also be present, usually from 1 to 25% thereof, preferably 5 to 20% or 10 to 15%. It results from the method of manufacture and helps in producing an article of desired abradability.

The fabric softening agent, humectant, if present, and reinforcing material, when employed, are intimately mixed and blended together to produce a uniform product, most preferably in the form of a sheet or strip from which the conditioning material is transferrable to fabrics in the dryer. Although sheet or strip form is highly preferred other forms of the reinforced product may also be produced, such as grains or particles, usually having a diameter of at least 0.1 mm. and no greater than 3 mm., preferably of 0.5 to 2 mm., in equivalent diameter. Instead of flat sheets or strips, curled strips, twisted strips and strips folded or curled into various shapes, e.g., triangles, parallelepipeds, circles, may also be employed. Normally, such materials will have a thickness of 0.3 to 2 mm. and a weight of 0.2 to 10 grams. Preferably, the thickness is from 0.8 to 1.5 mm. and the weight is from 0.5 to 5 grams. When sheets or strips are used sizes thereof are generally from 2 to 1,000 sq. cm., preferably 100 to 700 sq. cm. Ratios of surface to volume are usually from 20:1 to 400:1, preferably about 30:1 to 100:1. The strip or sheet forms of the product are especially easy to make, dispense and use but other forms of the reinforced articles are also within the invention.

In the various fabric conditioning articles of this invention mixtures of different fabric conditioners and reinforcing materials may be employed. Mixtures of the fabric softeners were previously discussed. It is also within the invention to mix fibers and particles, fibers and gums and particles and gums. Perhaps the most desirable of these mixtures are those of the finely divided cellulose fibers of the mentioned lengths and polyvinyl alcohol, in a weight ratio of 1 to 10 to 10 to 1, preferably 1 to 5 to 5 to 1. Such compositions are especially desirable when they contain from 1 to 20% of such reinforcing material, 1 to 15% of soap, 1 to 25% of glycerol, 5 to 20% coconut oil fatty alkyl dimethyl glycine or coconut oil fatty amido propyldimethyl glycine, and 5 to 2% water. Another useful formula is one which includes from 0.5 to 10% of di-lower alkyl di-higher alkyl ammonium halide, e.g., the bromide or chloride, 60 to 90% of higher fatty acid mono-lower alkanolamide, e.g., stearic monoethanolamide, 1 to 2% of $C_{7-10}$ alkyl phenoxy polyethoxy ethanol of 4 to 20 ethoxy groups per mol, e.g., Igepal CO-630 and from 2 to 20% of purified wood cellulose fibers of the described lengths and diameters. Such products condition laundry well and evenly, especially cellulosic fabrics, but are also useful in the conditioning and anti-static treatment of synthetics, e.g., nylons, polyesters.

The invented articles may be made by any of several suitable methods, providing that care is taken to maintain the homogeneity of the intimate mixture of conditioner and reinforcing agent or binder. Thus, a preferred method is to make a solution or melt of the fabric conditioning composition, usually including all materials except the reinforcing material, disperse the reinforcing materials in the solution or melt and solidify by drying or cooling fast enough to prevent separation of the reinforcing material from the conditioning composition. A preferred method is to disperse the reinforcing material and any other ingredients in a water solution or dispersion of the softener, e.g., a 30% solids solution of the glycine derivatives mentioned, form a layer thereof on a roll, remove the layer and dry it to a moisture content of about 10–15% while holding it fixed in shape in an air dryer, and remove it and roll it up, scoring for sheet separations, as desired. If cooling is used (when no evaporation is needed) it will normally be effected within 10 seconds to 5 minutes, preferably within ten seconds to thirty seconds and the product, thick enough to prevent migration of any component thereof, may then be milled or otherwise converted to strip or other desired form. Of course, it may also be molded into such form initially or the cooled product may be size reduced to such form and desired size. The humectant may be blended with the reinforcing means, if desired, and may be admixed as a part thereof with the rest of the conditioning composition.

In use, it is a simple matter merely to add the softening article to moist laundry or fabrics to be dried. The desired length of sheet or strip may be cut to obtain the correct conditioning in the time alloted for the weight of laundry present. The laundry treated is usually from 7 to 15 pounds in an automatic laundry dryer drum, the drying zone, and is initially of a moisture content of about 20 to 200%, on a dry laundry basis. The drum rotates at about 20 to 100 r.p.m. The drying air temperature is from 50° to 95° C. and the softening-drying operation time can be for a period of 2 minutes to 1 hour, normally from 5 to 45 minutes. The drying air carries out of the drying zone and away from the softened fabrics any finely divided cellulosic or other fibers or insoluble or dried particles removed from the softening article. This often includes a proportion, sometimes a major proportion of the gum material which may be present. Some fatty acid or polyalkylene glycol polymer may also be evacuated in this manner.

The air flow through the drying zone is usually from 1 to 100 volumes of air per minute and its linear velocity exiting from the dryer is from 1 to 50 feet per second, in usual operations. However, other air flows, temperatures, moisture contents, etc., may be employed providing that the conditions are maintained so that the softening material is removed from the article and the clothing and reinforcing material present are dried. Removal from the article may be aided by moistening and heating of the conditioning agent or composition and the reinforcement. This causes some softening of the material at the surface of the article and improves abradability. The softening agent is preferably one which softens but does not melt and run at dryer air conditions, 50° to 95° C.

The advantages of the invention have already been mentioned. Primarily, with respect to a preferred aspect of the invention, it is unexpectedly found that discontinuous or readily disintegrable reinforcing means have the power of stengthening a conditioning agent or composition so that it will not prematurely disintegrate in the dryer (if originally in strip or sheet form) and will maintain its initial particle size if originally in particulate form. Then, as the dryer is heated and the conditioning agent is abraded from the original article or articles, the reinforcing material remaining is dried and is removed from the clothing by the action of the drying air or gas or alternatively, if desired, some of it may deposit with the conditioning material on the laundry treated to impart useful properties to it. The softener is not carried out of the exhaust because when it is with reinforcing means the combined weight prevents the particle from being carried out by the exhaust air. Thus, it is no longer necessary for the operator of the dryer or the housewife to search out the substrate for the conditioning paper or other article. Sometimes in the past it was necessary to do this almost immediately after the dryer stopped because otherwise the conditioning agent (especially if cationic) that might still be present in the impregnated paper or on its surface could stain or mark the laundry against which it was held or pressed while remaining in the hot dryer after completion of the drying operation (especially if it was of synthetic or "permanent press" fabric). Now, it is no longer necessary for the housewife to make this special trip to remove the conditioning article and so the convenience of employing dryer softening of laundry is even further improved.

The following examples illustrate but do not limit the invention. Unless otherwise indicated, all parts are by weight and all temperatures are in °C.

EXAMPLE 1

| | Parts |
|---|---|
| Sodium soap (of 87:13 tallow:coconut oil mixture) | 10.5 |
| Glycerol | 25.0 |
| Polyvinyl alcohol (Elvanol, E. I. DuPont DeNemours & Co.) | 12.9 |
| Purified finely divided cellulose (Solka-Floc, Brown Corp.) | 6.9 |
| Coconut alkyl dimethyl glycine | 6.9 |
| Moisture | 10 |

A product of the above formula is made in sheet form, with a thickness of about 1 mm. and a width of about 30 centimeters by admixing the glycerol, 69 parts of water and the soap and heating to a temperature of 93° C., after which the cocodimethyl glycine, as a 30% aqueous solution in water (6.9 parts of CDG and 16.1 parts of water) and the polyvinyl alcohol are added and mixed until a clear solution is obtained. At this point, the Solka-Floc is mixed in and well dispersed, after which it is formed into a film on a chill roll, which film is conveyed on a moving stainless sheet through an air dryer, which dries it to a moisture content of 14% and from which it is removed by rolling onto a turning cylinder while simultaneously scoring the sheet for ready separation into desired lengths.

The sheet produced is flexible and resistant to breakage on handling. A length of 8 cm. is cut off from it and the 30 mm. width is cut in half, with half the 8 × 30 cm. sheet being used to condition all-cotton laundry and half being employed for mixed laundry, including permanent press, nylon, polyester and cotton items. Each of the pieces of softening article charged (one per dryer) weighs about 5 grams and each is charged to a laundry load of eight pounds of laundry in a Kenmore electric dryer in which the drying air is at about 60° C. The dryer drum turns at about 100 r.p.m. and there are about 20 air changes per minute. Drying is continued for 45 minutes for the cotton items and 30 minutes for the mixed load.

At the end of the drying operation the laundry is examined. It is dry and does not contain any visible cellulose or polyvinyl alcohol particles. It is soft and essentially staticfree or of low static charge. During the drying operation some breaking of the softening article strips occur but do not cause any difficulties. No staining of the laundry results. In short, the softening operations are highly successful and no residue of substrate is left for removal afterward.

In variations of the above formula the Solka-Floc is replaced by Varicel and CDG is replaced by coconut fatty acyl amidopropyl dimethyl glycine. Essentially the same type of satisfactory softening sheet article is produced and when it is used to treat laundry in a drying zone in an automatic laundry dryer essentially the same conditioning and anti-static results are obtained. The same processing and results are obtainable when the proportion of glycerol is decreased to 15 parts, the polyvinyl alcohol is omitted, the Solka-Floc is replaced by Solka-Floc BW (particle size being essentially the same and in the range given in the specification, essentially averaging about 5 microns in width and 50 microns in length), the soap is omitted and the conditioner employed is a mixture of stearic monoethanolamide and distearyl dimethyl ammonium chloride in 40:1 proportion and totaling 30 parts. Similar results obtain when the soap is replaced by sodium stearate. Preferably sodium soaps and anionic conditioners are employed in all the article compositions. Similar results obtain when the article size is increased to 22 × 30 cm. and the thickness is decreased to provide 5–10 grams of composition per sheet.

EXAMPLE 2

| | Parts |
|---|---|
| Sodium soap of 50 tallow:50 coco fat:oil mixture | 12.0 |
| Glycerol | 20.0 |

-continued

| | Parts |
|---|---|
| Polyvinyl alcohol | 15.0 |
| Coco-dimethyl glycine | 9.0 |
| Moisture | 10.0 |

The product of the above formula is made as a variation of that described in Example 1, omitting the fibrous reinforcing agent. The product is made by utilizing 30 parts of cocodimethyl glycine and 20 parts of water in the initial mix with the rest of the materials and it is processed as described in Example 1. The sheet obtained is of half the thickness, is cut to twice the width and is employed to soften laundry as described in Example 1. The product is not as strong as that of Example 1 and pieces do break apart more readily in the drying operation. However, satisfactory conditioning is obtained, with no staining and it is notable that the polyvinyl alcohol apparently gives the softened clothing additional body, which is desirable. When the formula is modified by the addition of nonionic softener (8 parts of $C_{7-10}$alkyl phenoxy polyethoxy ethanol), 3 parts of polyethylene glycol of molecular weight of about 20,000 and 2 parts of stearic acid, improved softening results and less breakage of the product in the dryer ensues. However, in all cases no visible residue is left in the dryer or on the laundry and no blockage of vents or lint traps occurs. Neither do any of the items have oily spots thereon from the softening agent.

EXAMPLE 3

| | Parts |
|---|---|
| Sodium soap of 85:15 tallow:coco fatty acids charge | 10 |
| Glycerol | 25 |
| Solka-Floc (purified fibrous cellulose) | 10 |
| Coco-dimethyl glycine | 25 |
| Moisture | 12 |

The above mix is made by the method described in Examples 1 and 2 and the thickness thereof and the sheet dimensions utilized are those of Example 1. It is noted that the product, containing cellulose and no polyvinyl alcohol, is not as strong as that of Example 1 but is comparable to that of Example 2. It conditions clothing similarly when used in the same manner as described in those examples and does not leave any objectionable visible residue.

When this formula is modified, using contents of soap, humectant (glycerol), reinforcing agent and softener over the ranges given in the preceding specification useful softening is obtained without objectionable residues. Of course, if insufficient softening results the proportion of softening agent will be increased and if there should be any tendency toward premature disintegration noted the proportion of reinforcing agents will usually be increased. When the product is too brittle, additional humectant or plasticizer (propylene glycol, glycerol, sorbitol or 50:50 mixture of glycerol and sorbitol is employed.

When the Solka-Floc in the above formula is replaced by Varicel, or a portion thereof is replaced by bentonite, talc, cotton threads, nylon fibers, silica or other such previously described materials, useful conditioning articles result which do not prematurely disintegrate on use and yet which disappear during and after application of the conditioning material to the laundry.

In a similar manner the formulas of Examples 1 and 2 are changed to replace the polyvinyl alcohol with sodium carboxymethyl cellulose, hydroxy propyl methyl cellulose and Irish moss, selectively. The products made are useful conditioning articles and have essentially the same properties as previously described for the other products of these examples.

EXAMPLE 4

| | Parts |
|---|---|
| Stearic monoethanolamide (Monad S, mfd. by Mona Industries) | 88 |
| Distearyl dimethyl ammonium chloride (Arquad 2HT, mfd. by Armour Chemical Co.) | 2 |
| Nonyl phenoxy polyethoxy ethanol (Triton N-101, mfd. by Rohm & Haas Co.) | 10 |
| Solka-Floc (purified wood cellulose, mfd. by Brown Company) | 6.0 |
| Glycerol | 0.1 |

A product of the above formula is made by mixing together the stearic monoethanolamide, quaternary ammonium compound and nonionic in one part and the Solka-Floc and glycerol in the other part and then mixing the two parts together at room temperature. The product is pressed or milled into 1 mm. thick sheets or otherwise is converted to desirable form. The sheets are cut to such sizes that result in approximately 3, 5 and 7 gram pieces, which are utilized for softening the dryer loads previously described with respect to Examples 1–3. The same advantages are observed and no stainings or oily spots are noted from the cationic conditioning agent.

In the above formula the Solka-Floc is replaced by polyvinyl alcohol, nylon strands, diaper fluff and various other reinforcing materials previously described, the glycerol is replaced by propylene glycol or a 50:50 mixture of glycerol and sorbitol and the nonionic is replaced by solid polyethoxy higher alkanols, e.g., Neodol 45-11, and others of greater solidity. Also, the distearyl dimethyl ammonium chloride is replaced with stearyl dimethyl benzyl ammonium chloride and in some instances the cationic is replaced with ten times the quantity thereof of anionic softener, e.g., sodium stearate. In all such cases a useful product results and good softening and anti-static effects are notable in the treated clothing, without objectionable residues on the clothing or in the dryer for removal. No substrates are employed and none are needed.

EXAMPLE 5

Soap leaves having a thickness of about 0.3 mm. are made from 1.0 part of sodium carboxymethyl cellulose, 0.5 part of purified wood pulp of the Solka-Floc type, 1.25 parts of polyglycerol (Emcol PG), 0.2 part of titanium dioxide, 0.1 part of bactericide, 0.02 part of preservative, 0.003 part of color solution (yellow), 67 parts of water, 9.1 parts of 85:15 tallow: coco soap chips and 1 part of vegetable oil.

The mixture of materials is dried to a moisture content of about 12% and is milled to a thin sheet. It is found that such sheets have sufficient resistance to be employable in the dryer without objectionably disintegrating prematurely. Laundry treated as described in the preceding examples is softened by the sheets when charged at the rate of about 5–10 grams per dryer load.

In a modification of this experiment ordinary soap sheets are employed and are found to be satisfactory.

However, they are better when they contain the polyglycerine, propylene glycol or glycerol humectants or mixture of these in the proportion given in this example. No visible residues or objectionable substrates have to be removed from the clothing or the dryer after use.

The invention has been described with respect to illustrative examples and working embodiments thereof but is not to be limited to these as it is evident that one or ordinary skill in the art will be able to utilize substitutes and equivalents without departing from the spirit of the invention or its scope.

What is claimed is:

1. A solid fabric softening and conditioning article in the form of a sheet with a surface to volume ratio of 20:1 to 400:1 which comprises, by weight 10–99% of at least one fabric softening compound selected from the group consisting of cationic, non-ionic, anionic, and zwitterionic fabric softening compounds and as a reinforcing material for such compound 1–40% of finely divided cellouse, microcrystalline protein or nylon fibers of a length of 0.005 to 0.1 mm and a diameter of 0.001 to 0.01 mm to prevent premature disintegration of the article during use in the softening of moving fabrics in the drying zone of an automatic laundry dryer by contact of the article with them to transfer softening agent to them, which reinforcing material gradually disintegrates during use of the softening article and leaves no residue in the drying zone after use thereof.

2. A fabric softening article according to claim 1 wherein the softening compound is an anionic softener.

3. A fabric softening article according to claim 2 wherein the anionic softener is a sodium soap of a higher fatty acid of 12–18 carbon atoms or a mixture of such acids, and the reinforcing material is finely divided cellulose fibers.

4. A fabric softening article according to claim 1 wherein the fabric softening compound is a zwitterionic fabric softener.

5. A fabric softening article according to claim 4 which comprises by weight from 0.5 to 10% of di-lower alkyl di-higher alkyl ammonium halide, 60 to 90% of higher fatty acid mono-lower alkanolamide, 1 to 20% of $C_{7-10}$ alkyl phenoxy polyethoxy ethanol of 4 to 20 ethoxy groups per mol and from 2 to 20% of purified wood cellulose fibers.

6. A fabric softening article according to claim 4 wherein the fabric softening compound is a higher fatty alkyl di-lower alkyl glycine or a higher fatty acyl amidopropyl di-lower alkyl glycine.

7. A fabric softening article according to claim 6 wherein a humectant is present.

8. A fabric softening article according to claim 7 wherein the fabric softening compound is a higher fatty alkyl dimethyl glycine and there is also present a sodium higher fatty acid soap.

9. A fabric softening article according to claim 8 which comprises by weight 10 to 97.5% of coconut oil fatty alkyl dimethyl glycine, 1 to 20% of sodium stearate, 0.5 to 30% of glycerol and 1 to 40% of reinforcing material.

10. A fabric softening article according to claim 9 wherein the article is a strip 0.3 to 2 mm. thick and of a weight of 0.2 to 10 grams, and the reinforcing material is a mixture of finely divided cellulose fibers of a length of 0.025 to 0.1 mm. and a diamter of 0.002 to 0.01 mm., and polyvinyl alcohol, in a weight ratio of about 1 to 10 to 10 to 1.

11. A method of making a strengthened fabric softening and conditioning article as defined in claim 1 which comprises preparing a solution of dispersion of the fabric, softening composition, dispersing the reinforcing material in such solution or dispersion and solidifying the solution or dispersion, in sheet form by evaporating moisture from it, thus cooling it fast enough, preventing separation of the reinforcing material from the softening composition.

* * * * *